US008093826B1

(12) United States Patent
Eagar et al.

(10) Patent No.: US 8,093,826 B1
(45) Date of Patent: Jan. 10, 2012

(54) CURRENT MODE SWITCHER HAVING NOVEL SWITCH MODE CONTROL TOPOLOGY AND RELATED METHOD

(75) Inventors: Dale R. Eagar, Black Forest, CO (US); Joseph V. DeNicholas, Longmont, CO (US)

(73) Assignee: National Semiconductor Corporation, Santa Clara, CA (US)

( * ) Notice: Subject to any disclaimer, the term of this patent is extended or adjusted under 35 U.S.C. 154(b) by 672 days.

(21) Appl. No.: 12/198,750

(22) Filed: Aug. 26, 2008 (Under 37 CFR 1.47)

(51) Int. Cl.
*G05F 1/00* (2006.01)

(52) U.S. Cl. ..... 315/291; 315/307; 315/308

(58) Field of Classification Search ..... 315/291–308
See application file for complete search history.

(56) References Cited

U.S. PATENT DOCUMENTS

| | | | | |
|---|---|---|---|---|
| 5,570,055 | A | 10/1996 | Gilbert | |
| 5,877,645 | A | 3/1999 | Comino et al. | |
| 6,172,492 | B1 | 1/2001 | Pletcher et al. | |
| 6,259,313 | B1 | 7/2001 | Lewicki | |
| 6,798,152 | B2 | 9/2004 | Rooke et al. | |
| 7,034,512 | B2 * | 4/2006 | Xu et al. | 323/283 |
| 7,119,498 | B2 | 10/2006 | Baldwin et al. | |
| 7,132,883 | B2 | 11/2006 | Huijsing et al. | |
| 7,268,609 | B2 | 9/2007 | van Staveren et al. | |
| 2002/0140378 | A1 * | 10/2002 | Volk et al. | 315/291 |
| 2006/0007220 | A1 * | 1/2006 | Perner | 345/207 |
| 2006/0170373 | A1 * | 8/2006 | Yang | 315/209 R |
| 2007/0229001 | A1 * | 10/2007 | McIntosh et al. | 315/307 |

OTHER PUBLICATIONS

Yuri Panov et al., "Adaptive Off-Time Control for Variable-Frequency, Soft-Switched Flyback Converter at Light Loads", IEEE Transactions on Power Electronics, vol. 17, No. 4, Jul. 2002, pp. 596-603.

In-Hwan Oh, "An Analysis of Current Accuracies in Peak and Hysteretic Current Controlled Power LED Drivers", 2008 IEEE, pp. 572-577.

K. Zhou et al., "Qusi-Active Power Factor Correction Circuit for HB LED Driver", 2007 IEEE, pp. 193-197.

"LM3402/LM3402HV 0.5A Constant Current Buck Regulator for Diving High Power LEDs" National Semiconductor, Oct. 2006, 22 pages.

"LM3402 Design Document", National Semiconductor, Sep. 2006, 2 pages.

"LM3404/04HV 1.0A Constant Current Buck Regulator for Diving High Power LEDs", National Semiconductor, Jun. 2007, 24 pages.

"LM3404/04HV 1.0A Constant Current Buck Regulator for Driving High Power LEDs", National Semiconductor, Oct. 2006, 2 pages.

Matthew Reynolds, "LM3402/LM3404 Fast Dimming and True Constant LED Current Evaluation Board", National Semiconductor, Jul. 24, 2008, 18 pages.

* cited by examiner

*Primary Examiner* — Douglas W Owens
*Assistant Examiner* — Amy Yang

(57) ABSTRACT

A system includes a first transistor configured to control a current through one or more LEDs and an inductor coupled in series with the one or more LEDs. The system also includes a current mode switcher configured to control the first transistor so that the inductor has a substantially constant ripple current. The system may further include a resistor and a second transistor coupled across the one or more LEDs and an integrating capacitor coupled in series with the second transistor. The switcher may include a driver configured to drive the first transistor to turn the first transistor on and off. The switcher may also include a detector configured to turn off the first transistor when a current through the first transistor exceeds a first threshold. The switcher may further include a timer configured to turn on the first transistor when a voltage on the integrating capacitor exceeds a second threshold.

21 Claims, 3 Drawing Sheets

CURRENT MODE SWITCHER HAVING NOVEL SWITCH MODE CONTROL TOPOLOGY AND RELATED METHOD

TECHNICAL FIELD

This disclosure is generally directed to current output switching regulators and more specifically to a current mode switcher having a novel switch mode control topology and related method.

BACKGROUND

In recent years, much interest has developed regarding the use of light emitting diode (LED) lights for illuminating homes, businesses, and other areas. LED lights can provide illumination more efficiently than conventional incandescent light bulbs, thereby requiring less power to operate. LED lights also typically have a much longer operational life than conventional incandescent light bulbs, thereby requiring fewer replacements. However, LED lights typically cannot be coupled directly to high-voltage supply lines, such as 115V or 230V supply lines. Rather, LED lights often require the use of power converters or other components, which typically increases the cost and installation complexity of the LED lights. Moreover, varying conditions (such as the number of lights or the supply voltage) typically alter the current through the LED lights, making it more difficult to control the LED lights.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Figure 1:
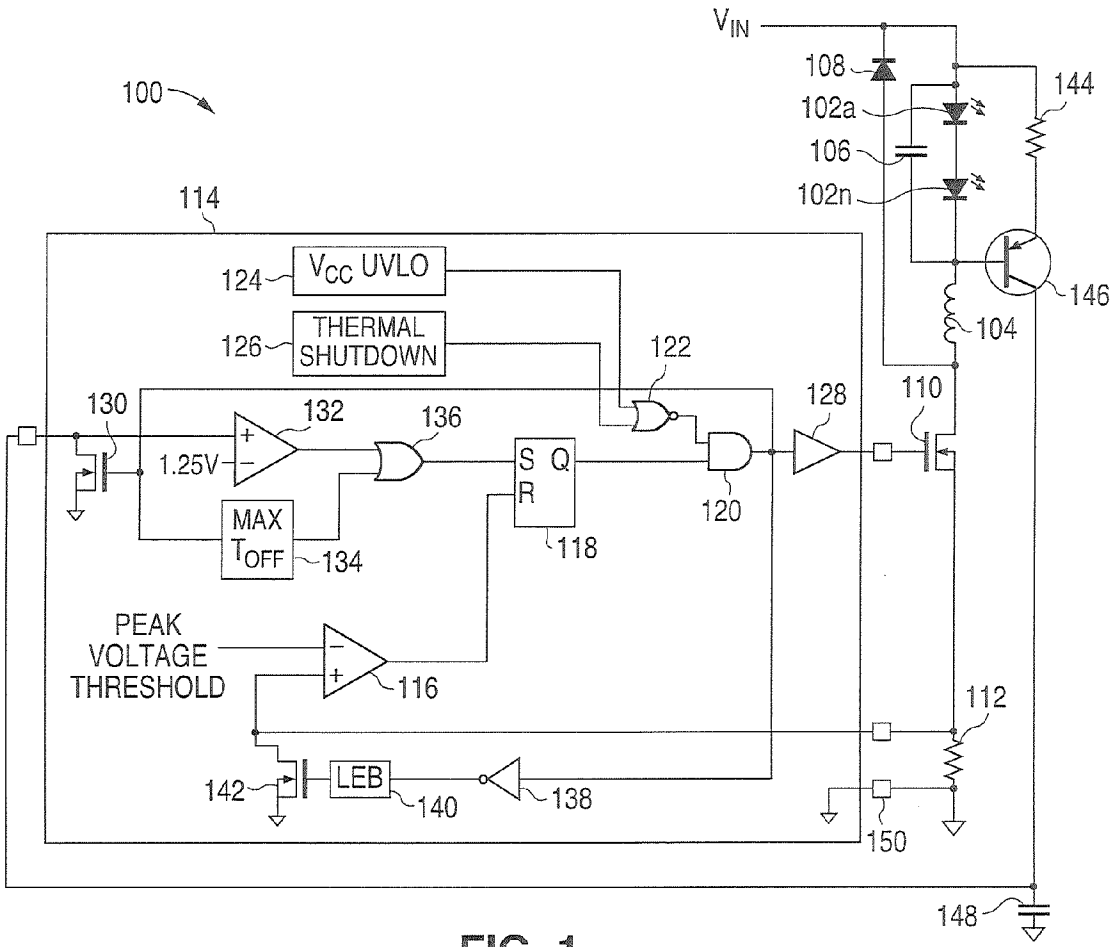
FIG. 1 illustrates a first example circuit having a current mode switcher with a novel switch mode control topology according to this disclosure.
Figure 2:
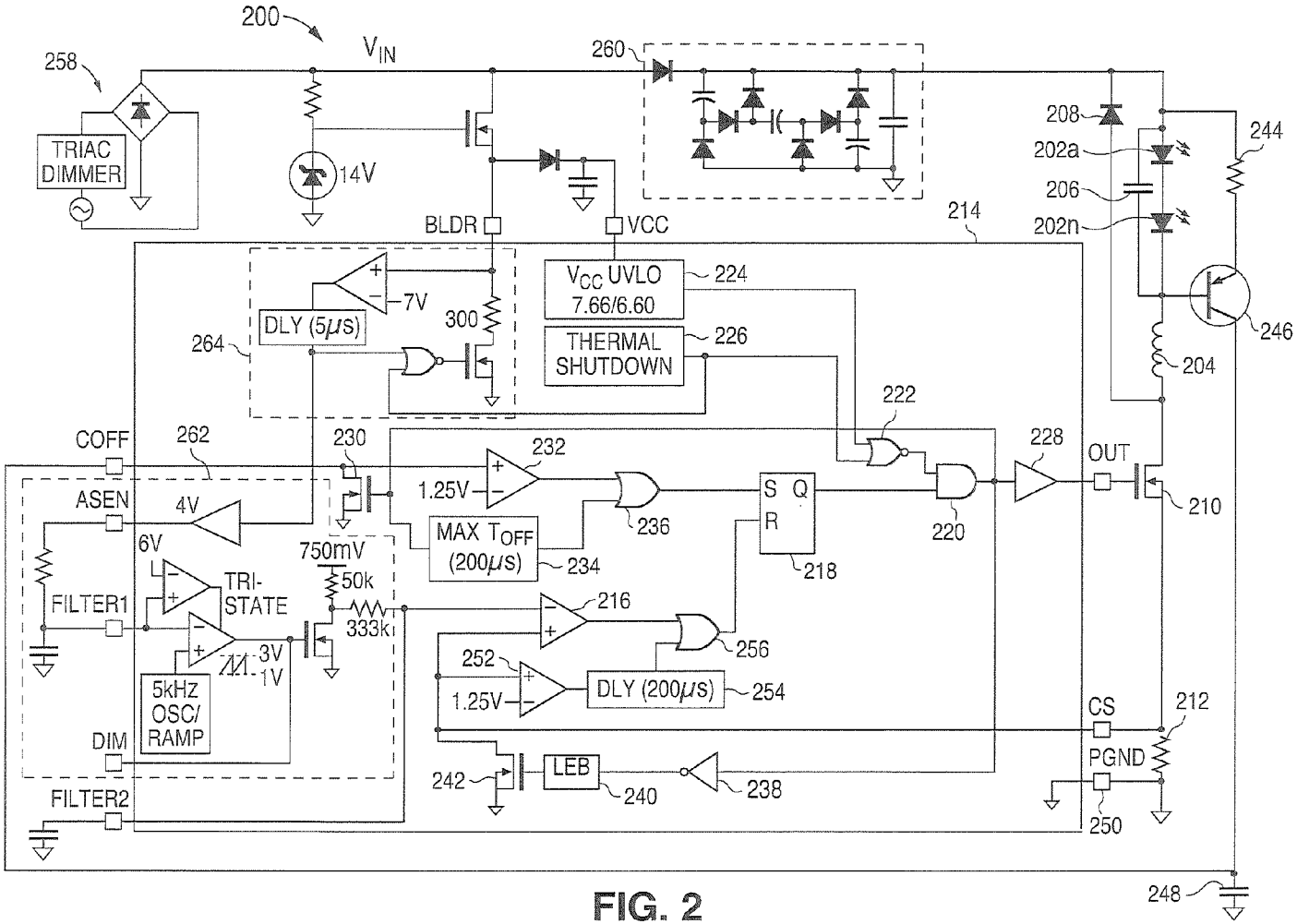
FIG. 2 illustrates a second example circuit having a current mode switcher with a novel switch mode control topology according to this disclosure.
Figure 3:
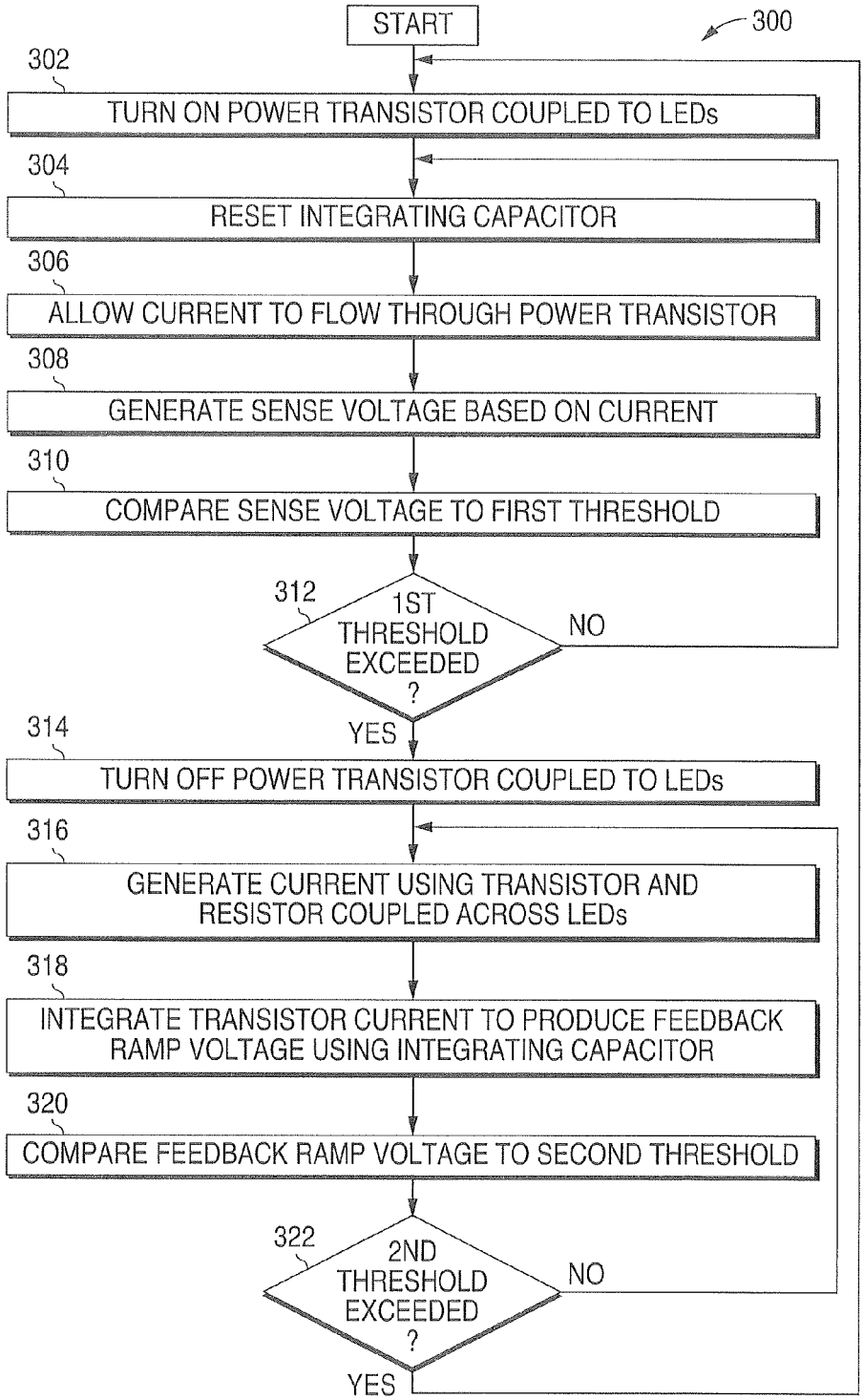
FIG. 3 illustrates an example method for controlling a current mode switcher according to this disclosure.

FIGS. 1 through 3, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

FIG. 1 illustrates a first example circuit 100 having a current mode switcher with a novel switch mode control topology according to this disclosure. The embodiment of the circuit 100 shown in FIG. 1 is for illustration only. Other embodiments of the circuit 100 could be used without departing from the scope of this disclosure.

As shown in FIG. 1, the circuit 100 includes one or more light emitting diodes (LEDs) 102*a*-102*n*. The LEDs 102*a*-102*n* generate light when current flows through the LEDs 102*a*-102*n*. The LEDs 102*a*-102*n* could generate any suitable light, such as white light, colored light, or any other suitable radiation. If multiple LEDs 102*a*-102*n* are used, the LEDs 102*a*-102*n* can be coupled in series, parallel, or series-parallel. The LEDs 102*a*-102*n* could also be used for any suitable purpose, such as when used in space lighting applications to illuminate homes, offices, or other areas. The LEDs 102*a*-102*n* include any suitable light emitting structures.

The LEDs 102*a*-102*n* are coupled in series with an inductor 104 and in parallel with a capacitor 106. Current flowing through the LEDs 102*a*-102*n* also flows through the inductor 104. The inductor 104 could have any suitable inductance (such as an inductance based on the expected current through the LEDs 102*a*-102*n*). The capacitor 106 could have any suitable capacitance.

A recirculation diode 108 is coupled in parallel with the circuit path containing the LEDs 102*a*-102*n*, the inductor 104, and the capacitor 106. The recirculation diode 108 can help to recirculate current from the inductor 104 back through the LEDs 102*a*-102*n*. The recirculation diode 108 represents any suitable structure operating as a diode.

A power transistor 110 is coupled to the inductor 104. The power transistor 110 generally controls the flow of current through the LEDs 102*a*-102*n*. For example, the power transistor 110 can be repeatedly turned on and off using a pulse width modulation (PWM) control scheme. This allows current to flow through the LEDs 102*a*-102*n*, and the LEDs 102*a*-102*n* can generate light. The power transistor 110 represents any suitable transistor capable of selectively conducting current that flows through one or more LEDs, such as a metal oxide semiconductor field effect transistor (MOSFET).

A sense resistor 112 is coupled between the power transistor 110 and ground. Current flowing through the power transistor 110 also flows through the sense resistor 112, creating a voltage across the sense resistor 112. As described below, the voltage across the sense resistor 112 can be used to control the peak current through the LEDs 102*a*-102*n*. The sense resistor 112 could have any suitable resistance, such as a resistance based on the expected current through the power transistor 110.

The circuit 100 further includes LED regulation circuitry 114. The LED regulation circuitry 114 generally operates to drive the power transistor 110 and control the flow of current through the LEDs 102*a*-102*n*. For example, the LED regulation circuitry 114 could use a PWM control scheme to repeatedly turn the power transistor 110 on and off. This can be done to control the brightness, color temperature, or other characteristic(s) of the light generated by the LEDs 102*a*-102*n*.

In this example, the LED regulation circuitry 114 includes a comparator 116, which compares the voltage across the sense resistor 112 with a peak threshold voltage. The peak threshold voltage generally denotes the maximum peak voltage allowed across the sense resistor 112 for a specified illumination (such as a specified brightness). The peak threshold voltage could be provided to the comparator 116 from any suitable source. The comparator 116 includes any suitable structure for comparing voltages.

An output signal from the comparator 116 is provided to a latch 118. The latch 118 samples and stores an input signal received at a first input (denoted S) and outputs the sampled value. The output of the comparator 116 is coupled to a reset input (denoted R) of the latch 118. When the comparator 116 outputs a low logical value, this allows the latch 118 to sample and hold the S input signal. When the comparator 116 outputs a high logical value, this resets or clears the latch 118. The latch 118 represents any suitable structure for sampling and holding a signal, such as an SR latch.

The output (denoted Q) of the latch 118 provides an output signal to combinatorial logic formed by an AND gate 120 and a NOR gate 122. The AND gate 120 receives the output signal from the latch 118 and an output signal from the NOR gate 122 and performs a logical AND operation. The NOR gate 122 receives output signals from two units, a $V_{CC}$ under voltage lockout (UVLO) circuit 124 and a thermal shutdown unit 126, and performs a logical NOR operation. The UVLO circuit 124 detects when a supply voltage $V_{CC}$ for the LED regulation circuitry 114 becomes too low, and the thermal shutdown unit 126 detects when the temperature of the circuit 100 becomes too high. In this embodiment, the UVLO circuit 124 outputs a high logical value when the supply voltage $V_{CC}$ becomes too low, and the thermal shutdown unit 126 outputs a high logical value when the temperature of the circuit 100 becomes too high. If either condition is detected, the NOR gate 122 outputs a low logical value, causing the AND gate 120 to output a low logical value and to turn the power transistor 110 off. When neither condition is detected, the NOR gate 122 outputs a high logical value, and the output signal generated by the AND gate 120 equals the output signal provided by the latch 118. The gates 118-120 represent any suitable logic gates. The UVLO circuit 124 represents any suitable structure capable of identifying an under-voltage condition. The thermal shutdown unit 126 represents any suitable structure capable of identifying an excessive temperature.

The AND gate 120 provides an output signal to a driver 128, which drives the power transistor 110. For example, based on the output signal of the AND gate 120, the driver 128 could generate a signal that controls whether the power transistor 110 is on or off. The driver 128 includes any suitable structure for generating signals for driving a transistor.

The "S" input signal provided to the latch 118 is generated using a transistor 130, a comparator 132, a maximum off timer 134, and an OR gate 136. The transistor 130 has a drain terminal coupled to a non-inverting input of the comparator 132 and to a feedback voltage, and the transistor 130 has a source terminal coupled to ground. The comparator 132 has an inverting input coupled to a fixed voltage (1.25V in this example). The gate of the transistor 130 is coupled to the output of the AND gate 120 and an input of the maximum off timer 134. The transistor 130 represents any suitable transistor, such as a MOSFET. The comparator 132 includes any suitable structure for comparing voltages. The maximum off timer 134 represents any suitable timing structure for generating an output after a specified time period has elapsed.

The LED regulation circuitry 114 further includes an inverter 138, a leading edge blanking (LEB) unit 140, and a transistor 142. These components help to suppress the effects of noise caused by the power transistor 110 and the diode 108. In particular, the power transistor 110 can create current spikes when the driver 128 turns the power transistor 110 on, and the diode 108 can undergo reverse recovery that generates further noise. These components 138-142 can help to reduce or eliminate any effects caused by this noise. This can be accomplished by using the transistor 142 to ground the non-inverting input of the comparator 116 for a time, during which the current from the power transistor 110 can stabilize and the diode 108 can complete its reverse recovery.

In this example, the feedback voltage provided to the comparator 132 is generated using a resistor 144, a transistor 146, and a capacitor 148. The resistor 144 is coupled in parallel with the LEDs 102*a*-102*n*. The transistor 146 in this embodiment represents a PNP bipolar transistor (although other types of transistors could be used). In this embodiment, the transistor 146 has an emitter coupled to the resistor 144, a base coupled between the LEDs 102*a*-102*n* and the inductor 104, and a collector coupled to the capacitor 148. The resistor 144 could have any suitable resistance, and the capacitor 148 could have any suitable capacitance.

The circuit 100 operates to control the power transistor 110 based on the current flowing through the LEDs 102*a*-102*n*, thereby forming a "current mode switcher." The circuit 100 also operates to compare the peak current flowing through the LEDs 102*a*-102*n* to a threshold, thereby forming a "peak current mode" switcher. This function is implemented using the comparator 116. When the power transistor 110 is turned on, a voltage is formed across the sense resistor 112. When this voltage exceeds the threshold value, the comparator 116 resets the latch 118, causing the AND gate 120 to turn off the power transistor 110. In this way, the circuit 100 controls the peak current flowing through the LEDs 102*a*-102*n*.

In addition, the circuit 100 controls the power transistor 110 using PWM, where the signal driving the power transistor 110 is on for a period of time ($T_{ON}$) and off for a period of time ($T_{OFF}$). The off time $T_{OFF}$ can be controlled in the circuit 100 using a timer, thereby forming a "predictive off time" peak current mode switcher. During operation, the off time $T_{OFF}$ of the circuit 100 can be determined using the following function:

$$T_{OFF} = \frac{k}{V_{LED}} \tag{1}$$

where k is a constant and $V_{LED}$ is the voltage across the LEDs 102*a*-102*n*. The voltage across the LEDs 102*a*-102*n* can also be expressed using the following function:

$$V_{LED} = \frac{L \times \Delta I}{T_{OFF}} \tag{2}$$

where L represents the inductance of the inductor 104 and ΔI represents the change in inductor current through the inductor 104. Inserting Equation (1) into Equation (2) produces the following:

$$k = L \times \Delta I. \tag{3}$$

Since k and L are constants, ΔI also becomes a constant in this situation, meaning the ripple current through the inductor 104 is constant. With a fixed peak current and a fixed ripple current, the average current through the LEDs 102*a*-102*n* can be controlled by the circuit 100.

This timer function can be implemented using the resistor 144 and the transistor 146, which are coupled across the stack or bank of LEDs 102*a*-102*n*. A collector current generated by the transistor 146 is proportional to the instantaneous output voltage (at the junction between the LEDs 102*a*-102*n* and the inductor 104). The collector current is integrated by the capacitor 148 to produce a feedback ramp voltage, which is inversely proportional to the current flowing through the inductor 104 (and therefore also inversely proportional to the current flowing through the LEDs 102*a*-102*n*).

As a result, the voltage stored on the capacitor 148 is typically reset when the power transistor 110 is turned on. The reset can occur when the transistor 130 couples the line from the capacitor 130 to ground, resetting the voltage on the capacitor 148. The voltage stored on the capacitor 148 then increases when the power transistor 110 is turned off. This voltage is compared to a fixed voltage by the comparator 132. Eventually, this voltage becomes large enough to exceed the fixed voltage, which turns the power transistor 110 back on. In this way, a timer is formed that operates based on the feedback ramp voltage formed on the capacitor 148. Moreover, the inductor current through the inductor 104 has a fixed or constant ripple, enabling more precise control of the current through the LEDs 102*a*-102*n*.

The timer also uses the maximum off timer 134 to prevent the LED regulation circuitry 114 from turning the power transistor 110 off for longer than a specified time, such as 200 μs. For example, the maximum off timer 134 could detect when the output of the AND gate 120 goes low and begin outputting a low logical signal. After a specified time period, the maximum off timer 134 can begin outputting a high logical signal. The OR gate 136 combines the output signals from the comparator 132 and the maximum off timer 134 to generate the signal that is sampled by the latch 118. In this way, the maximum off timer 134 ensures that the OR gate 136 outputs a high logical value at least after the specified time period has elapsed, which turns the power transistor 110 back on at least after the specified time period has elapsed.

The circuit 100 can control the current through the LEDs 102*a*-102*n* on a cycle-by-cycle basis, regardless of changes in the LEDs 102*a*-102*n*, changes in a supply voltage $V_{IN}$, and changes in the output voltage (at the junction between the LEDs 102*a*-102*n* and the inductor 104). Also, the LEDs 102*a*-102*n* can be coupled directly to a high-voltage supply line and controlled using low-voltage process components (such as those components in the LED regulation circuitry 114). This allows the use of lower-voltage integrated circuits without overstress. Various other benefits can be obtained using the circuit 100, such as fast PWM current control of LEDs, inherent stability of the circuit, and current settling performance that can be used in many implementations without the need for any external control loops. In addition, components such as the transistor 146 can represent very inexpensive components, helping to simplify the overall design of the circuit 100 and to keep the cost of the circuit 100 down.

In particular embodiments, the LED regulation circuitry 114 is implemented on a single integrated circuit chip. Also, the chip has various input/output (I/O) terminals 150. These terminals 150 allow internal components of the LED regulation circuitry 114 to be electrically coupled to external components. The terminals 150 represent any suitable structures providing electrical contact between components within an integrated circuit chip and external components.

Although FIG. 1 illustrates a first example circuit 100 having a current mode switcher with a novel switch mode control topology, various changes may be made to FIG. 1. For example, the combinatorial logic and other components shown in FIG. 1 are for illustration only. Different combinatorial logic or other components performing the same or similar functions could be used in the circuit 100. Also, various components could be omitted, combined, or further subdivided and additional components could be added according to particular needs.

FIG. 2 illustrates a second example circuit 200 having a current mode switcher with a novel switch mode control topology according to this disclosure. The embodiment of the circuit 200 shown in FIG. 2 is for illustration only. Other embodiments of the circuit 200 could be used without departing from the scope of this disclosure.

The circuit 200 shown in FIG. 2 operates in a similar manner as the circuit 100 shown in FIG. 1. The circuit 200 includes various components 202*a*-250, which may be the same as or similar to the corresponding components 102*a*-150 shown in FIG. 1 and described above. In this example, the output of a comparator 216 (used for peak current detection) is not coupled directly to a reset input of a latch 218. Rather, a comparator 252 compares the voltage across a sense resistor 212 against a current limit threshold value (1.25V in this example). An output signal from the comparator 252 is provided to a delay unit 254, which delays the output signal for a specified amount of time (such as 200 μs). The outputs of the comparator 216 and the delay unit 254 are coupled to an OR gate 256, which performs a logical OR operation. The output of the OR gate 256 is coupled to the reset input of the latch 218. The comparator 252 here implements a current limiting function, helping to ensure that an excessive amount of current is not passing through a power transistor 210. If this condition occurs, the comparator 252 outputs a high logical value to reset the latch 218 and turn the power transistor 210 off. The comparator 252 includes any suitable structure for comparing voltages. The delay unit 254 includes any suitable structure for delaying a signal.

The circuit 200 includes other components for performing various other functions. For example, triac dimmer circuitry 258 can be used to manually adjust a supply voltage $V_{IN}$, which may allow the brightness of the light emitted by LEDs 202*a*-202*n* to be manually controlled. The circuit 200 also includes passive power-factor correction (PFC) circuitry 260, which can be used to correct any non-linearities in the load placed on the supply voltage $V_{IN}$. A dim decoder 262 facilitates interaction with standard light dimmers. The dim decoder 262 here can generate a peak threshold voltage based on the current dimmer setting, and that peak threshold voltage can be provided to the comparator 216. Angle detection and bleeder circuitry 264 (along with some external circuitry coupled to the "BLDR" terminal) can, among other things, provide or block signals from reaching the dim decoder 262.

Once again, the circuit 200 implements both a peak detector and an off timer, which can be used to more accurately control the LEDs 202*a*-202*n*. The off time $T_{OFF}$ of the circuit 200 can be controlled using the timer, which includes a resistor 244 and a transistor 246. A collector current from the transistor 246 is integrated by a capacitor 248, and the resulting voltage is provided to a comparator 232 for comparison. The timer also uses a maximum off timer 234 to prevent the power transistor 210 from being turned off for longer than a specified time, such as 200 μs. The peak current detector includes the comparator 216, which compares the voltage across the sense resistor 212 to the peak threshold voltage. Based on the output from the comparator 216, the comparator 216 can reset the latch 218, causing an AND gate 220 to turn off the power transistor 210. In particular embodiments, LED regulation circuitry 214 is implemented on a single integrated circuit chip with various I/O terminals 250.

Although FIG. 2 illustrates a second example circuit 200 having a current mode switcher with a novel switch mode control topology, various changes may be made to FIG. 2. For example, the combinatorial logic and other components shown in FIG. 2 are for illustration only. Different combinatorial logic or other components performing the same or similar functions could be used in the circuit 200. Also, various components could be omitted, combined, or further subdivided and additional components could be added according to particular needs.

FIG. 3 illustrates an example method 300 for controlling a current mode switcher according to this disclosure. The embodiment of the method 300 shown in FIG. 3 is for illustration only. Other embodiments of the method 300 could be used without departing from the scope of this disclosure. Also, for ease of explanation, the method 300 is described with respect to the circuit 100 of FIG. 1. The method 300 could be used with the circuit 200 of FIG. 2 or any other suitable current mode switcher.

A power transistor coupled to one or more LEDs is turned on at step 302. This could include, for example, the LED regulation circuitry 114 providing a suitable signal to the gate of the power transistor 110 to turn the power transistor 110 on. An integrating capacitor is reset at step 304. This could include, for example, the transistor 130 coupling one end of the capacitor 148 to ground. Since the other end of the capacitor 148 is also coupled to ground, this resets the voltage stored on the capacitor.

Current flows through the power transistor at step 306. This could include, for example, the power transistor 110 allowing current to flow through the power transistor 110 to the sense resistor 112. A sense voltage based on the current is generated at step 308. This could include, for example, the current flowing through the sense resistor 112 producing a voltage across the sense resistor 112.

The sense voltage is compared to a first threshold at step 310. This could include, for example, the comparator 116 comparing the voltage across the sense resistor 112 to a peak threshold voltage. If the sense voltage does not exceed the first threshold at step 312, the method 300 returns to step 304. At this point, the peak current through the LEDs 102*a*-102*n* has not exceeded a maximum peak current. Otherwise, the power transistor is turned off at step 314. In this case, the peak current through the LEDs 102*a*-102*n* has exceeded the maximum peak current, and the power transistor 110 is turned off.

The amount of time that the power transistor remains off is determined using a timer. A current is generated using a transistor and a resistor coupled across the LEDs at step 316. This could include, for example, the transistor 146 generating a collector current. The transistor current is integrated to produce a feedback ramp voltage using the integrating capacitor at step 316. This could include, for example, the capacitor 148 integrating the collector current from the transistor 146. The integrated voltage is inversely proportional to the output voltage at the inductor 104.

The feedback ramp voltage is compared to a second threshold at step 320. This could include, for example, the comparator 132 comparing the feedback ramp voltage to a threshold voltage of 1.25V. If the feedback ramp voltage does not exceed the second threshold at step 322, the method 300 returns to step 316. At this point, an inadequate amount of time has elapsed. Otherwise, the method 300 returns to step 302 where the power transistor is turned on and the process repeats itself.

Although FIG. 3 illustrates an example method 300 for controlling a current mode switcher, various changes may be made to FIG. 3. For example, while shown as a series of steps, various steps in FIG. 3 could overlap, occur in parallel, occur in a different order, or occur multiple times.

It may be advantageous to set forth definitions of certain words and phrases that have been used within this patent document. The term "couple" and its derivatives refer to any direct or indirect communication between two or more components, whether or not those components are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this invention. Other changes, substitutions, and alterations are also possible without departing from the spirit and scope of this invention as defined by the following claims.

What is claimed is:

1. A circuit comprising:

a driver configured to drive a first transistor to turn the first transistor on and off in order to control a current through one or more light emitting diodes;

a detector configured to turn off the first transistor when a current through the first transistor exceeds a first threshold; and a timer configured to turn on the first transistor when a voltage on an integrating capacitor exceeds a second threshold.

2. The circuit of claim 1, wherein the detector comprises a first comparator configured to compare (i) a voltage across a sense resistor coupled in series with the first transistor and (ii) the first threshold.

3. The circuit of claim 2, further comprising:

a latch configured to sample and hold an input signal, the first comparator configured to reset the latch when the voltage across the sense resistor exceeds the first threshold.

4. The circuit of claim 3, further comprising:

an AND gate having a first input, a second input coupled to an output of the latch, and an output coupled to the driver; and a NOR gate having a first input coupled to a low-voltage detector, a second input coupled to a thermal detector, and an output coupled to the first input of the AND gate.

5. The circuit of claim 3, wherein the timer comprises a second comparator configured to compare the voltage on the integrating capacitor and the second threshold.

6. The circuit of claim 5, wherein the timer further comprises:

a maximum off timer configured to turn on the first transistor after a specified time period; and an OR gate having a first input coupled to an output of the second comparator, a second input coupled to an output of the maximum off timer, and an output coupled to the latch, the OR gate configured to provide the input signal to the latch.

7. The circuit of claim 5, wherein the timer further comprises a second transistor coupled to the second comparator, the second transistor configured to reset the voltage on the integrating capacitor when the driver turns on the first transistor.

8. The circuit of claim 7, further comprising:

a resistor and a third transistor coupled across the one or more light emitting diodes, the third transistor coupled in series with the resistor; and the integrating capacitor coupled in series with the third transistor.

9. The circuit of claim 8, wherein:

when the first transistor is off, the third transistor is configured to generate a current proportional to an instantaneous output voltage of the one or more light emitting diodes; and the integrating capacitor is configured to integrate the current proportional to the instantaneous output voltage of the one or more light emitting diodes.

10. The circuit of claim 8, further comprising:

an inductor coupled in series between the one or more light emitting diodes and the first transistor;

wherein the third transistor comprises a PNP bipolar transistor having an emitter coupled to the resistor, a base coupled between the one or more light emitting diodes and the inductor, and a collector coupled to the integrating capacitor.

11. A system comprising:

a first transistor configured to control a current through one or more light emitting diodes and an inductor coupled in series with the one or more light emitting diodes; and a current mode switcher configured to control the first transistor so that the inductor has a substantially constant ripple current, wherein the current mode switcher comprises: a driver configured to drive the first transistor to turn the first transistor on and off; a detector configured to turn off the first transistor when a current through the first transistor exceeds a first threshold; and a timer configured to turn on the first transistor when a voltage on an integrating capacitor exceeds a second threshold.

12. The system of claim 11, further comprising:

a resistor and a second transistor coupled across the one or more light emitting diodes, the second transistor coupled in series with the resistor; and an integrating capacitor coupled in series with the second transistor.

13. The system of claim 12, wherein the second transistor comprises a PNP bipolar transistor having an emitter coupled to the resistor, a base coupled between the one or more light emitting diodes and the inductor, and a collector coupled to the integrating capacitor.

14. The system of claim 11, wherein the detector comprises a first comparator configured to compare (i) a voltage across a sense resistor coupled in series with the first transistor and (ii) the first threshold.

15. The system of claim 14, wherein the current mode switcher further comprises:

a latch configured to sample and hold an input signal, the first comparator configured to reset the latch when the voltage across the sense resistor exceeds the first threshold.

16. The system of claim 15, wherein the timer comprises a second comparator configured to compare the voltage on the integrating capacitor and the second threshold.

17. The system of claim 16, wherein the timer further comprises:

a maximum off timer configured to turn on the first transistor after a specified time period; and an OR gate having a first input coupled to an output of the second comparator, a second input coupled to an output of the maximum off timer, and an output coupled to the latch, the OR gate configured to provide the input signal to the latch.

18. The system of claim 16, wherein the timer further comprises a second transistor coupled to the second comparator, the second transistor configured to reset the voltage on the integrating capacitor when the driver turns on the first transistor.

19. A method comprising:

turning a first transistor on to allow a first current to flow through the first transistor, the first transistor coupled to one or more light emitting diodes;

turning the first transistor off when the first current exceeds a first threshold;

integrating a second current using an integrating capacitor, the second current proportional to an instantaneous output voltage of the one or more light emitting diodes; and turning the first transistor back on when a voltage on the integrating capacitor exceeds a second threshold.

20. The method of claim 19, further comprising:

resetting the voltage on the integrating capacitor when the first transistor is turned back on.

21. The method of claim 19, further comprising:

generating the second current using a second transistor, the second transistor coupled in series with a resistor and in series with the integrating capacitor, the resistor and the second transistor coupled across the one or more light emitting diodes.

* * * * *